US005398842A

United States Patent [19]

Sokolski et al.

[11] Patent Number: 5,398,842

[45] Date of Patent: Mar. 21, 1995

[54] THERMAL CONTAINER

[75] Inventors: Robert Sokolski; John Downey, both of Warren, Pa.

[73] Assignee: Whirley Industries, Inc., Warren, Pa.

[21] Appl. No.: 889,155

[22] Filed: May 27, 1992

[51] Int. Cl.[6] ..... B61D 23/00

[52] U.S. Cl. ..... 220/630; 220/739; 220/636; 220/367

[58] Field of Search ..... 220/420, 738, 739, 737, 220/307, 625, 630, 636, 367

[56] References Cited

U.S. PATENT DOCUMENTS

| | | | |
|---|---|---|---|
| 2,526,165 | 10/1950 | Smith . | |
| 2,995,267 | 8/1961 | Ostrander, Jr. . | |
| 3,071,281 | 1/1963 | Sawai | 220/611 |
| 3,138,280 | 6/1964 | Shafer | 220/739 |
| 3,189,229 | 6/1965 | Carroll et al. . | |
| 3,624,788 | 11/1971 | McMahon | 220/738 |
| 3,804,281 | 4/1974 | Eckdahl . | |
| 4,504,009 | 3/1985 | Boik et al. | 220/307 |
| 4,562,937 | 1/1986 | Iyengar | 220/307 |
| 4,570,454 | 2/1986 | Campbell . | |
| 4,726,553 | 2/1988 | Wischusen, III | 220/738 |
| 4,747,507 | 5/1988 | Fitzgerald et al. | 220/739 |
| 4,793,491 | 12/1988 | Wolf et al. | 220/444 |
| 5,092,488 | 3/1992 | Pradel | 220/600 |
| 5,180,077 | 1/1993 | Lewis | 220/611 |

FOREIGN PATENT DOCUMENTS

| | | | |
|---|---|---|---|
| 915714 | 11/1946 | France | 220/625 |

*Primary Examiner*—Joseph Man-Fu Moy

*Attorney, Agent, or Firm*—Reed Smith Shaw & McClay

[57] ABSTRACT

A double-walled, thermal container is disclosed in which the outer portion and the inner cup are formed by a unitary piece of molded polymer. The present invention also provides a double-walled thermal mug including a removable base element. The removable base element allows the user of the thermal mug to conceal articles within the annular space between the outer enclosing portion and the inner cup. The removable base also allows insertion of an insulating sleeve. A double-walled thermal mug including can abutment means for positioning a beverage can within the inner cup of the thermal mug is also disclosed.

12 Claims, 11 Drawing Sheets

THERMAL CONTAINER

FIELD OF THE INVENTION

The present invention relates to a double-walled, thermal container and especially to a double-walled, thermal mug in which the inner and outer portions are formed of an integral, seamless piece of material and also to a double-walled thermal mug with a removable base or bottom.

BACKGROUND OF THE INVENTION

Many devices are available to keep a beverage at a desired temperature. Some such devices include an inner portion surrounded by an outer portion with annular chamber therebetween. In U.S. Pat. No. 4,570,454, for example, a double-walled drinking vessel having a heat maintenance chamber between an inner wall and an outer wall of the vessel is disclosed. A fluid is placed between the walls, and the fluid is either heated or cooled depending upon the temperature desired for the beverage to be placed within the inner tumbler of the drinking vessel. The drinking vessel also includes an annular base in the form of a skirt that is placed around and below the bottom of the vessel. The skirt has a plurality of spaced orifices which provide for air circulation underneath the vessel, thus preventing condensation from occurring on the supporting surface. The inner tumbler and outer container are separate pieces which are suitably connected by an inner connecting annular enclosure region.

Similarly, U.S. Pat. No. 2,995,267 discloses an ice bucket having a bottom portion and a top portion. The bottom portion and the top portion are both made entirely of plastic. The bottom is shaped in a cup-like formation with a generally flattened lower surface and side walls diverging upwardly and rising to an upper peripheral free edge. The top portion has a central depression having a somewhat rounded bottom and generally cylindrical side walls. These side walls roll over or outwardly to form an upper smooth edge. From the upper smooth edge an integral skirt depends and terminates at a peripheral free edge. The skirt is angularly spaced at all points from the side wall of the depression so that a predetermined gap or air space exists between the surface walls. The upper free edge of the bottom portion is circular and has a predetermined diameter. The lower free edge of the skirt on the top is also circular and has a corresponding diameter. These diameters are the same so that the two edges may be brought together and heat sealed. The resulting product is an ice bucket in which the side wall of the bottom forms a continuation of the upper skirt and provides a uniform and continuous annular spacing from the inner depression at all points.

U.S. Pat. No. 3,189,229 also discloses a container having an enclosed annular space to keep a contained beverage at a desired temperature. The container is a pitcher which comprises a main body part, a base part and cover, each of which may be formed from a plastic. The body part includes an inner receptacle or container having a generally cylindrical wall and bottom wall and an outer casing or skirt concentric with the wall but terminating in a stepped lower edge short of the bottom wall. The bottom or base part is a one piece, cup-shaped member having short side walls. The top edge of which is stepped and a concaved bottom wall with radial downwardly extending ribs. The bottom is assembled with the body by fitting the edge onto the edge of the body and subsequently spinning the bottom by friction engagement with the ribs relative to the body to fuse the parts together. Accordingly, the bottom becomes in effect a part of the pitcher and a double wall is provided at the bottom as well as the sides of the pitcher.

Double walled containers are also disclosed in U.S. Pat. Nos. 3,804,281 and 2,526,165.

Until the present, no double-walled containers have been formed from a unitary piece of material. Two-piece assemblies such as those described above, however, are very difficult to manufacture with total success.

The normal method of assembling two-pieced, double-wailed containers is spin welding. Generally, in spin welding two components molded separately are joined by rotating one within the other, creating a melting action to fuse the two components together. That method frequently leaves an unsightly "flash" residue at the joint. Moreover, the joint usually occurs at the most undesirable position, near the top, outer edge or lip of the container. The flash must either be removed as a costly extra production step or the integrity of the weld must be compromised to reduce or eliminate the flash.

Spin welding joints are frequently incomplete. Poor welding in a two-piece design can permit contaminants to enter the annular void area between the outer and inner wails. Because the component parts cannot be disassembled, the contamination can never be removed. Distasteful odors and elevated bacteria levels may result. The danger of contamination is especially great during dishwasher cleaning.

Moreover, separate inner and outer wall components of a double-walled container are expensive to mold because each component requires a separate mold and molding machine.

It is an object of the present invention to substantially reduce or eliminate these problems associated with two-pieced, double-walled containers.

It is also desirable for a double-walled container to have a base portion to prevent formation of condensate. Prior containers of this type, disclose base portions permanently attached to the container. It is also an object of the present invention to provide a thermal container having a removable base portion.

SUMMARY OF THE INVENTION

Accordingly, the present invention generally comprises a container having an outer enclosing portion and an inner cup portion. The outer enclosing portion and the inner cup portion meet near the top rim of the container so that an annular space is formed therebetween. The outer enclosing portion and the inner cup portion are manufactured of an integral piece of material. Preferably a molded polymeric material such as polypropylene or polyethylene is used.

An integral or seamless design can accomplish the same function as a two-piece design without risk of contaminants entering the annular space. Furthermore, manufacture of an integral container requires only one mold and one molding machine, thereby enabling a substantial savings in storage and handling of parts-in-process. Additionally, an integral design requires approximately 50% less manufacturing space.

Still further, the draft angle of an integral design enables a greater bottom diameter to top diameter ratio than achievable in a two-piece design. The draft angle is the internal taper required to remove the part from the mold. In the case of spin welded components, joined together near the top of the vessel, both parts must taper downward, making them larger at the top than at the bottom. An integral design, on the other hand, tapers outward at the bottom. The bottom or base diameter of the mug is thereby greater than the top diameter of the mug. Therefore, an integral design is more stable when resting upon a surface than is a two-piece design.

The present invention also comprises a mug including a removable base element. The removable base element can be placed in the bottom of mug to prevent condensate from forming and contacting a surface upon which the mug rests. The removable base element allows the user of the mug to place articles within the fully enclosed annular space created by the outer enclosing portion, the inner cup and the bottom element. Such a mug is very useful, for example, to conceal valuable articles such as keys, credit cards or currency while at the beach.

The removable bottom portion also allows installation and removal of an insulating element or sleeve within the annular space to improve the insulating character of the mug.

DETAILED DESCRIPTION OF THE INVENTION

Figure 1:
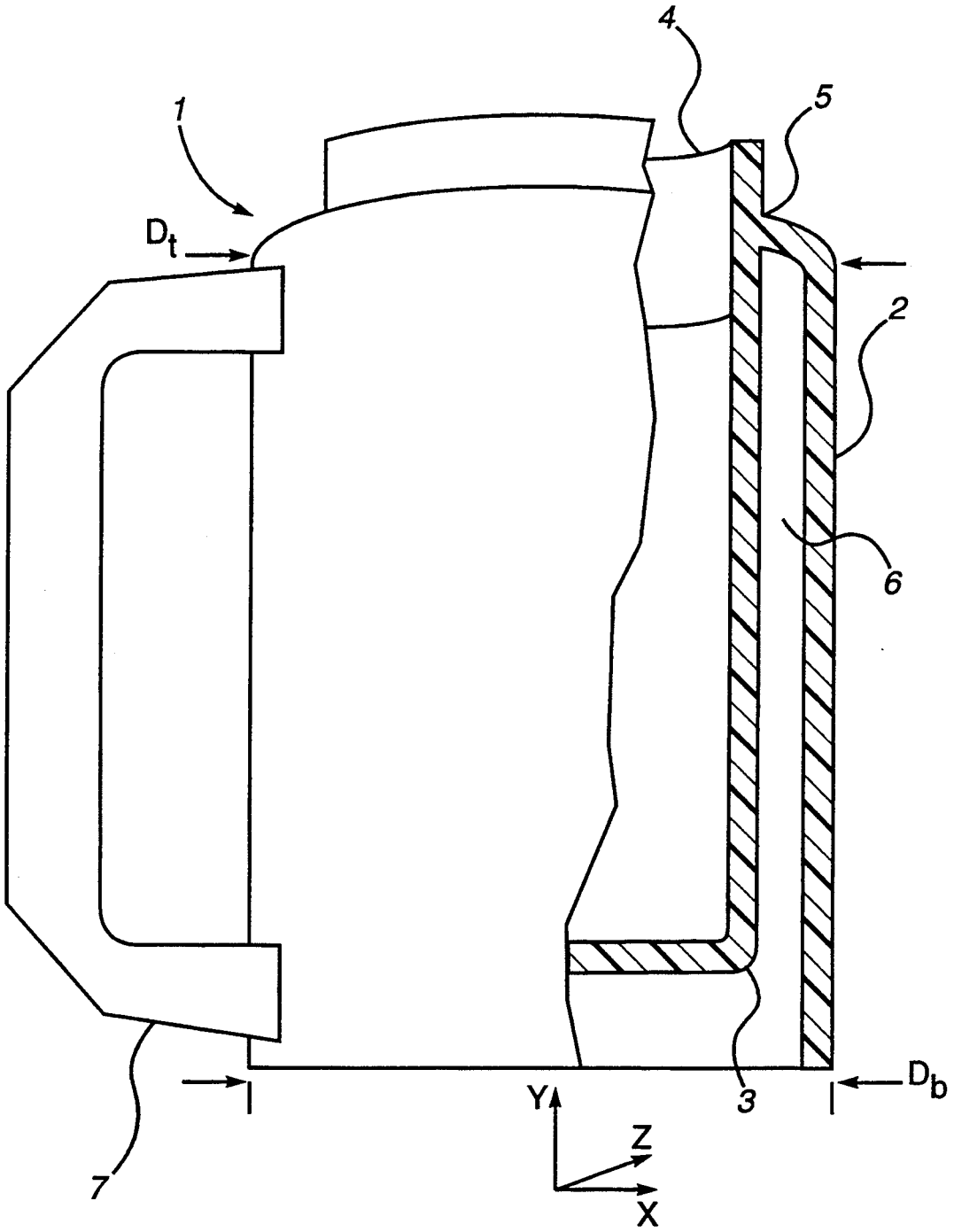
FIG. 1 is a front proportional view of one embodiment of the present invention showing a mug in partial cross section.

An embodiment of the present container is illustrated in FIG. 1 as mug 1. Mug 1 comprises an outer enclosing portion 2 and an inner cup portion 3. Near an upper rim 4 of mug 1, outer enclosing portion 2 and inner cup portion 3 meet at intersection 5 to form a partially enclosed annular area 6. Preferably a handle means 7 is attached, preferably by welding, to outer enclosing portion 2 of thermal mug 1.

It can be seen in the cross sectional area of the FIG. 1 that mug 1 is constructed of an integral piece of material. Preferably a molded polymeric material is used. Polypropylene and polyethylene are examples of suitable polymeric material.

Nowhere in outer enclosing portion 2 and inner cup portion 3 of mug 1 is there a seam where independent portions of polymer are "welded" together or otherwise attached. Rotation of the integral , two-dimensional shaded area shown in the cross sectional portion FIG. 1 360° around the Y axis produces single piece thermal mug 1.

Mug 1 according to the present invention is preferably made by injection molding. Generally, the mold has two "core" sides (male parts), one of which is standard. The other part is a tube-shaped core side. The tube-shaped core side must be thin enough to fit within the angular space provided in the cup design but withstand injection pressures on the magnitude of 7,000 psi.

In general, parts that are molded begin to shrink immediately in the mold and therefore must be forceably removed from the core. This removal is usually done by moving a stripper plate around the core, stripping the part from the core. Because two cores are required in the present invention, this stripping action must be mechanically sequenced so that the molded part strips from one core first and then the other.

Preferably, large pneumatic pistons supply the first stripping action, and then, at a proper press opening, two racks attached to the moving side of the mold drive pinions which draw a second stripper plate towards the first, ejecting the part.

To allow removal of the mug from the core sides, the mug tapers outward at the bottom. As shown in FIG. 1, the present integral design thus allows mug 1 to have a greater bottom diameter $D_b$ than top diameter $D_t$, (i.e., outer enclosing portion 2 tapers outward from top to bottom) thereby improving the stability of mug 1.

Figure 2:
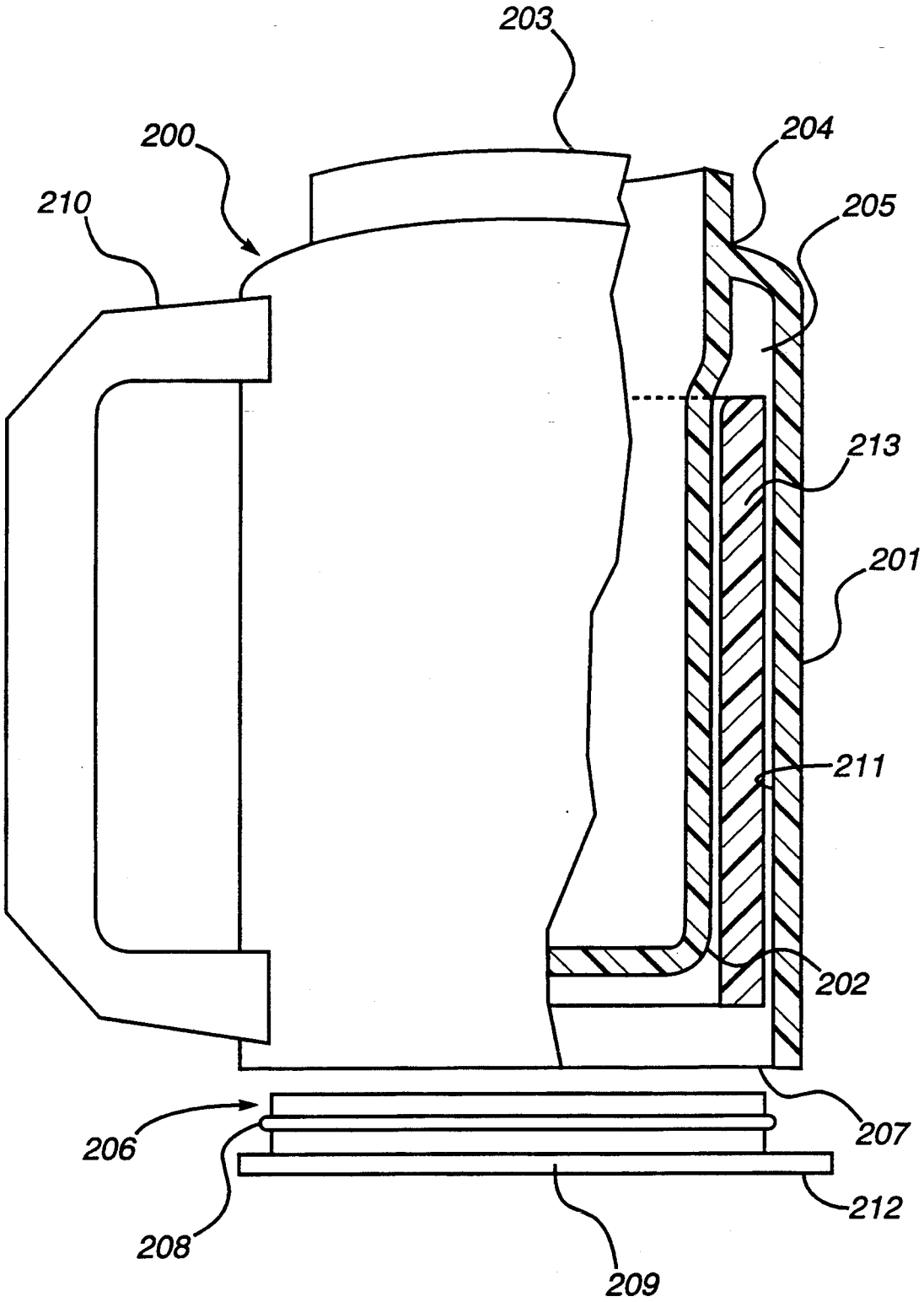
FIG. 2 is a front proportional view of an embodiment of the present invention in partial cross section showing a mug with a removal base element.

A further embodiment of a thermal mug 200 is illustrated in FIG. 2. Mug 200 includes an outer enclosing portion 201 and an inner cup portion 202. Near the upper rim 203 of mug 200 outer enclosing portion 201 and inner cup portion 202 meet at intersection 204 to form a partially enclosed annular space 205. Mug 200 also preferably includes a removable base element 206. Base 206 is designed to fit snugly within the bottom opening 207 of mug 200 created by the substantially cylindrical outer enclosing wall 201. Base 206 preferably includes an annular abutment means 208 to contact outer enclosing portion 201 when base 206 is placed within the bottom 207 of mug 200. In FIG. 2 base 206 is shown disconnected and below mug 200. Base 206 also preferably includes support element 209 which contacts the surface upon which mug 200 rests. Preferably, outer enclosing portion 207, inner cup portion and rim 203 are constructed of an integral piece of polymeric material as described above. Removeable base element 206 is, however, a substantial improvement even in two-piece designs. Mug 200 also preferably includes a handle means 210 attached thereto to facilitate use of the mug.

Figure 3:
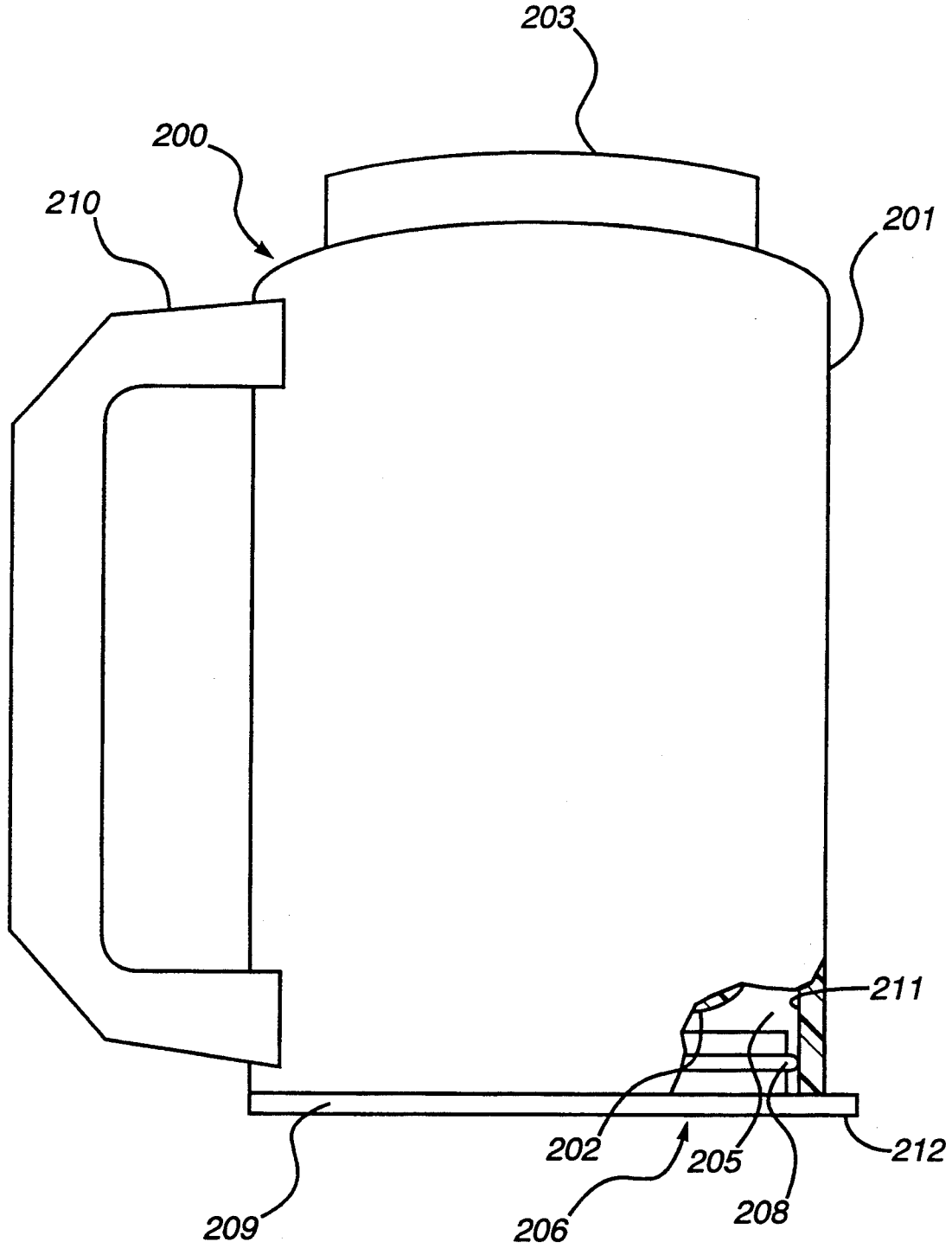
FIG. 3 is a front proportional view of an embodiment of the present invention in partial cross section showing a mug with a removable base element disposed therein.

In FIG. 3, mug 200 is illustrated with base 206 securely within mug 200. It is seen that annular abutment element 208 contacts the inner surface 211 of outer enclosing portion 201 so that base 206 remains within mug 200. It is also seen that inner cup 202 extends downwardly only to such an extent to prevent interference with the placement of base portion 206 within thermal mug 200.

Figure 4:
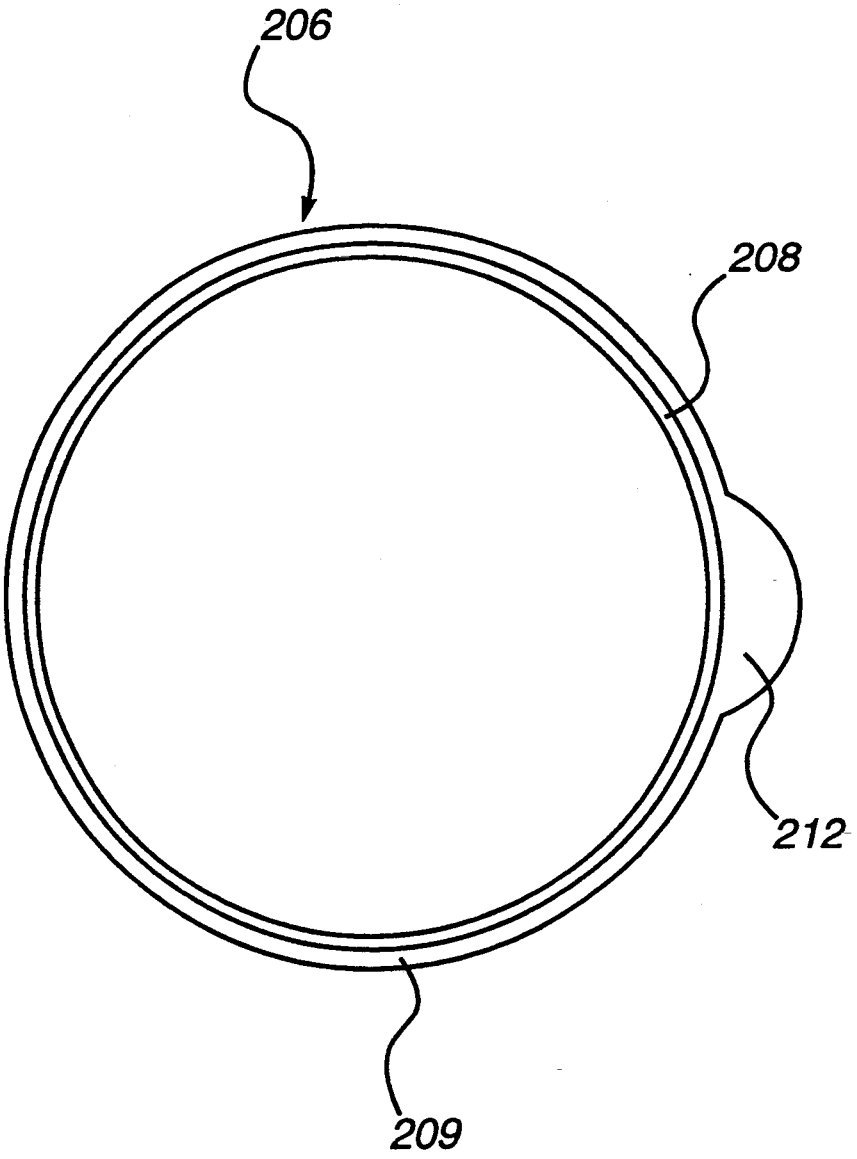
FIG. 4 is a top view of an embodiment of a base element.

Base 206 also preferably includes a means 212 for grasping base 206 to remove base 206 from mug 200. This means 212 for grasping base 206 preferably is a tab 212. Tab 212 is best illustrated in FIG. 4. In FIG. 4 it is seen that tab 212 is an extended portion of support element 209.

Upon insertion of base 206 in mug 200, annular space 205 becomes completely enclosed. Because air is a very good insulator, enclosed annular space 205 provides excellent insulation for a beverage contained within inner cup portion 202 of mug 200. Because base 206 is relatively easily removed from mug 200, the user of mug 200 may use the enclosed annular space 205 for storing or concealing various articles. The use of enclosed annular space 205 is particularly appealing to conceal valuables while at places such as a public beach.

Removable base 206 also allows the insertion of a removable insulating element or sleeve 213 shown in cross section in FIG. 2. Insulating sleeve 213 is preferably of a substantially cylindrical shape to substantially occupy annular space 205. Insulating sleeve 213 is preferably manufactured from a polymeric foam known to have good insulating characteristics. Foamed polystyrene is an example of a suitable material for insulating sleeve 213.

Insulating sleeve 213 is most preferably of a shape to conform substantially to the annular space 205 (i.e., to the draft angle of mug 200). By providing a very close fit between insulating sleeve 213 and mug 200, the insulating effect is maximized. It is not possible to satisfy both a requirement of a close fit and removability in a two-piece design because the draft angle of a two-piece design requires the mug to taper outward at the top. Thus, if an insulating sleeve is designed to conform to the annular space in such a mug, it will be very difficult to remove the sleeve.

Figure 5:
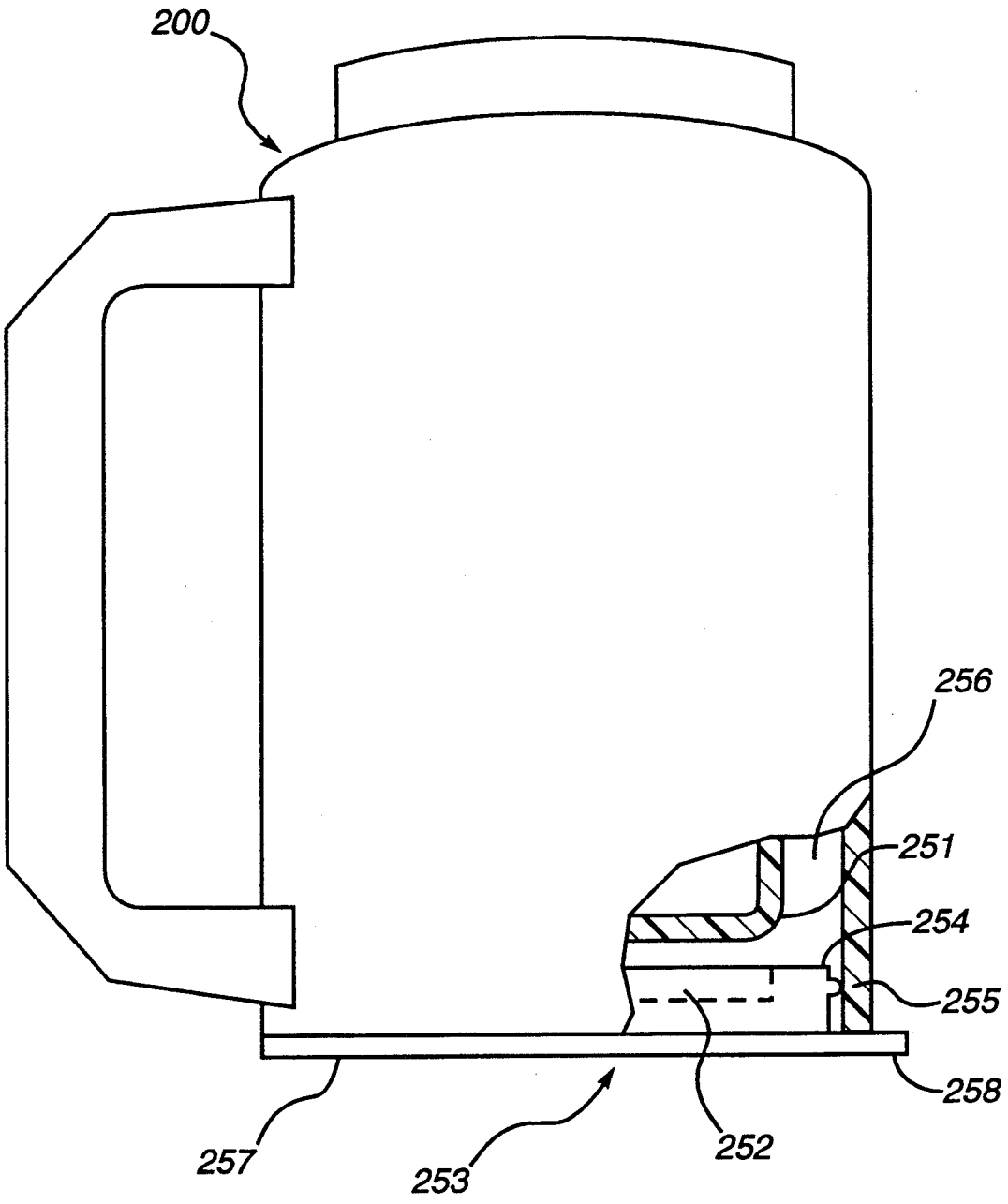
FIG. 5 is a front proportional view of an embodiment of the present invention showing a mug in partial cross section having a removable base element within a depression formed therein.

A further embodiment of a mug 250 is shown in FIG. 5. In this embodiment, raised rim 254 defines a depression 252 and produces a spring-like force upon abutment means 255 to facilitate a substantially leak-proof seal between base 253 and mug 250. In this manner, base portion 253 seals annular space 256 from the outside air to prevent condensation.

Figure 6:
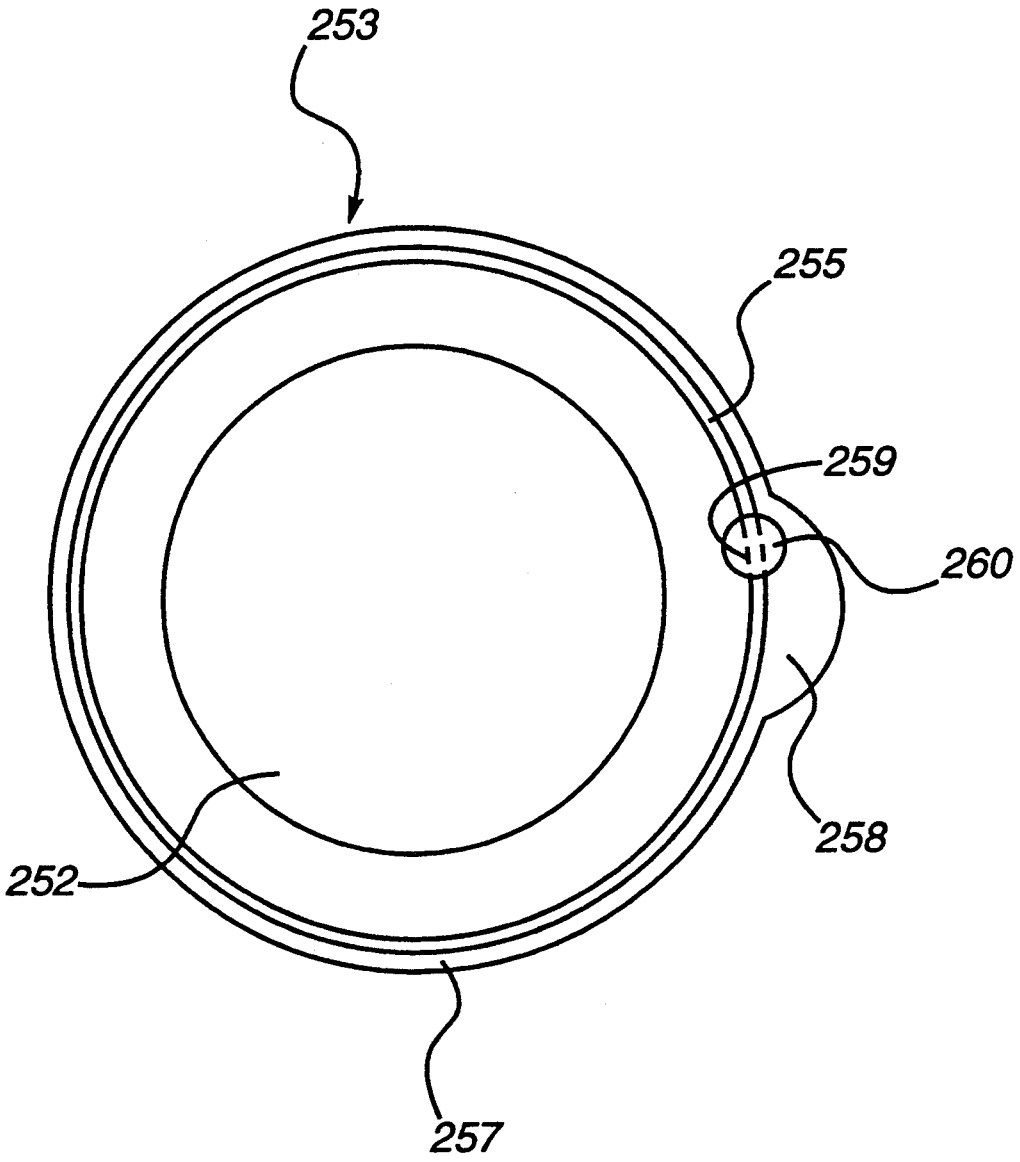
FIG. 6 is a top view of an embodiment of a base element.

A top view of base 253 is shown in FIG. 6. As shown in FIG. 6, base 253 also preferably includes support element 257, and tab 258, the operation of which has been described above. As also shown in FIG. 6, base 253 preferably includes a means for releasing pressure which may build within annular space 255 of mug 250 as a result of temperature increase (e.g., in a dishwasher). As shown in FIG. 6, base 253 is preferably provided with a channel 259 to release such pressure.

Base 253 also preferably includes a depression 260 in connection with channel 259 to provide fluid connection between channel 259 and ambient air when base 253 is in place in mug 250. Channel 259 is preferably minimal in size to maintain the insulating properties of mug 250.

Figure 7:
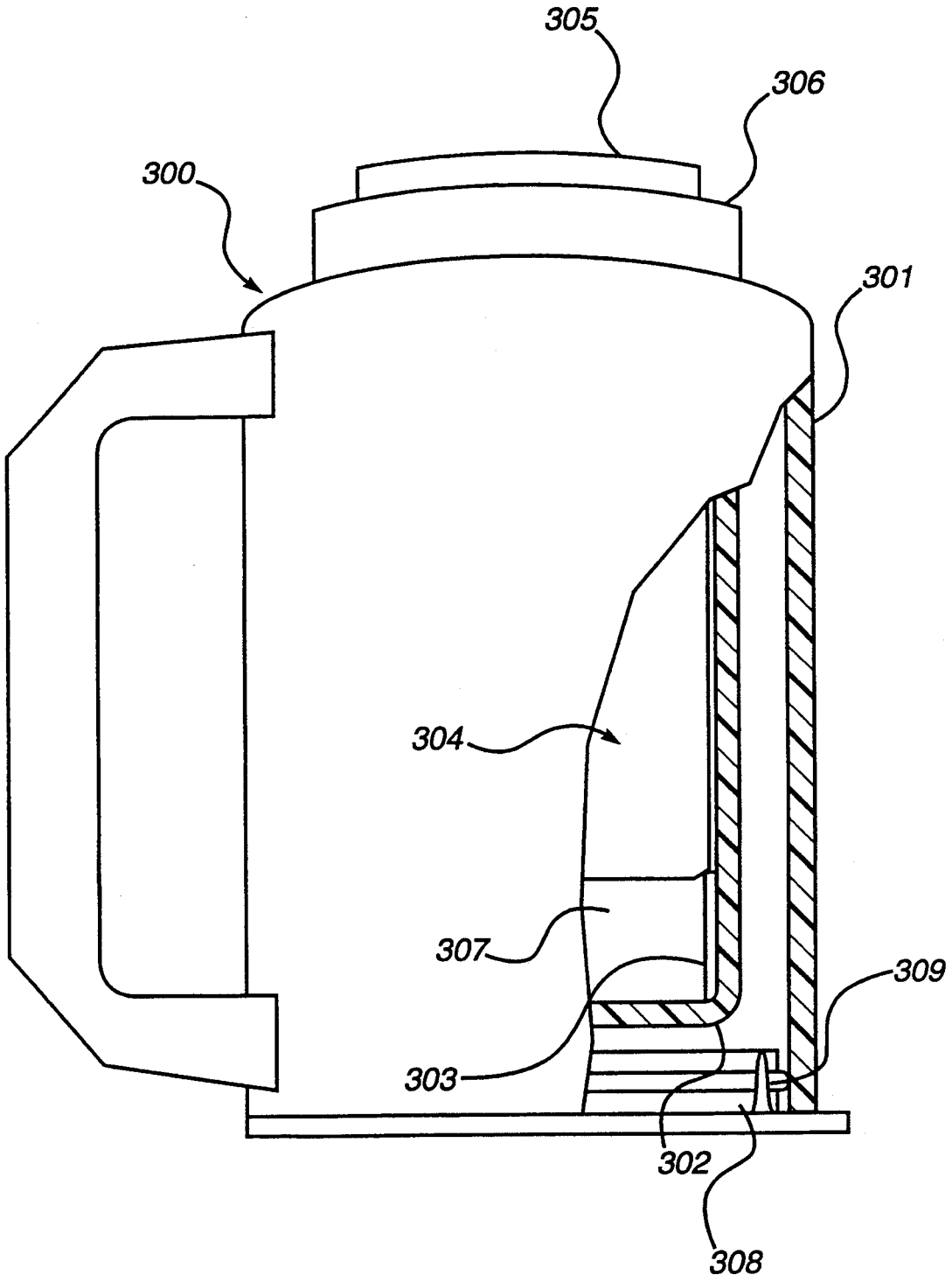
FIG. 7 is a front proportional view of an embodiment of the present invention in partial cross section showing can abutment means to engage a drinking can.
Figure 8:
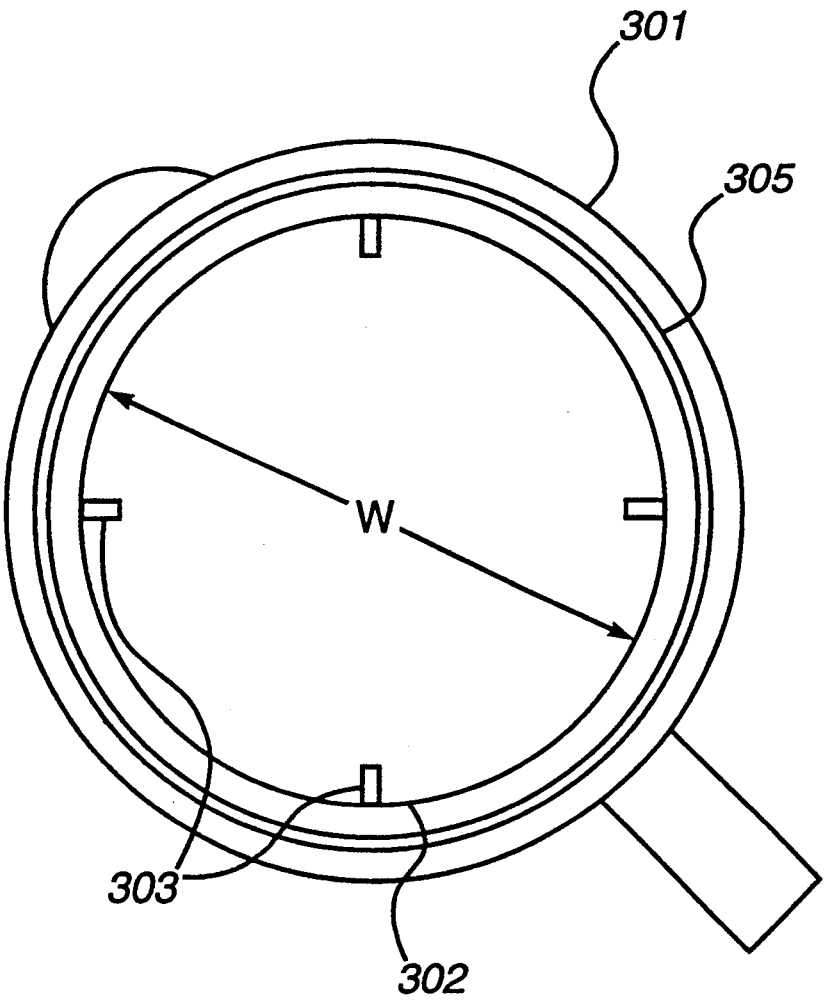
FIG. 8 is a top view of an embodiment of the present invention showing can abutment means to engage a drinking can.

In FIGS. 7 and 8 a further embodiment of the present invention is illustrated in mug 300. Mug 300 preferably comprises an outer enclosing portion 301 and an inner cup portion 302. Mug 300 preferably includes at least one abutment means 303 for contacting a beverage can 304. Preferably there are at least two can abutment means 303 which extend inwardly from inner cup 302. Most preferably there are four such can abutment means 303. Alternatively, a single can abutment means could be used extending upwardly from the bottom portion of inner cup 302 preferably near the center of the bottom portion of cup 302.

Can abutment means 303 preferably contact beverage can 304 to position beverage can 304 within mug 300 such that the upper rim 305 of beverage cup 300 extends slightly beyond the upper rim 306 of mug 300. It is preferable that the upper rim 305 of beverage can 304 extend up above the rim 306 of mug 300 so that beverage can 304 is easily removable from mug 300. This design also facilitates the drinking of the beverage contained within beverage can 304. The inner width W of inner cup 302 is preferably such that a standard drinking can fits within mug 300 with relatively little space between the beverage can 304 and the inner wall of inner cup 302 (see FIG. 6). Can abutment means 303 preferably extend a sufficient distance inwardly to prevent beverage can 304 from becoming wedged therebetween.

Mug 300 thus supports a beverage can in a perfect drinking position, giving one drinking a beverage from such a can the facility and comfort of a mug while maintaining the temperature of the fluid within the can. To better maintain the temperature of cold beverages within beverage can 304, ice can be placed in the space 307 between the bottom of can 304 and the bottom inner surface of inner cup 302.

FIG. 7 also illustrates a means for releasing pressure disposed in base portion 308 in the form of channel 309.

Figure 9:
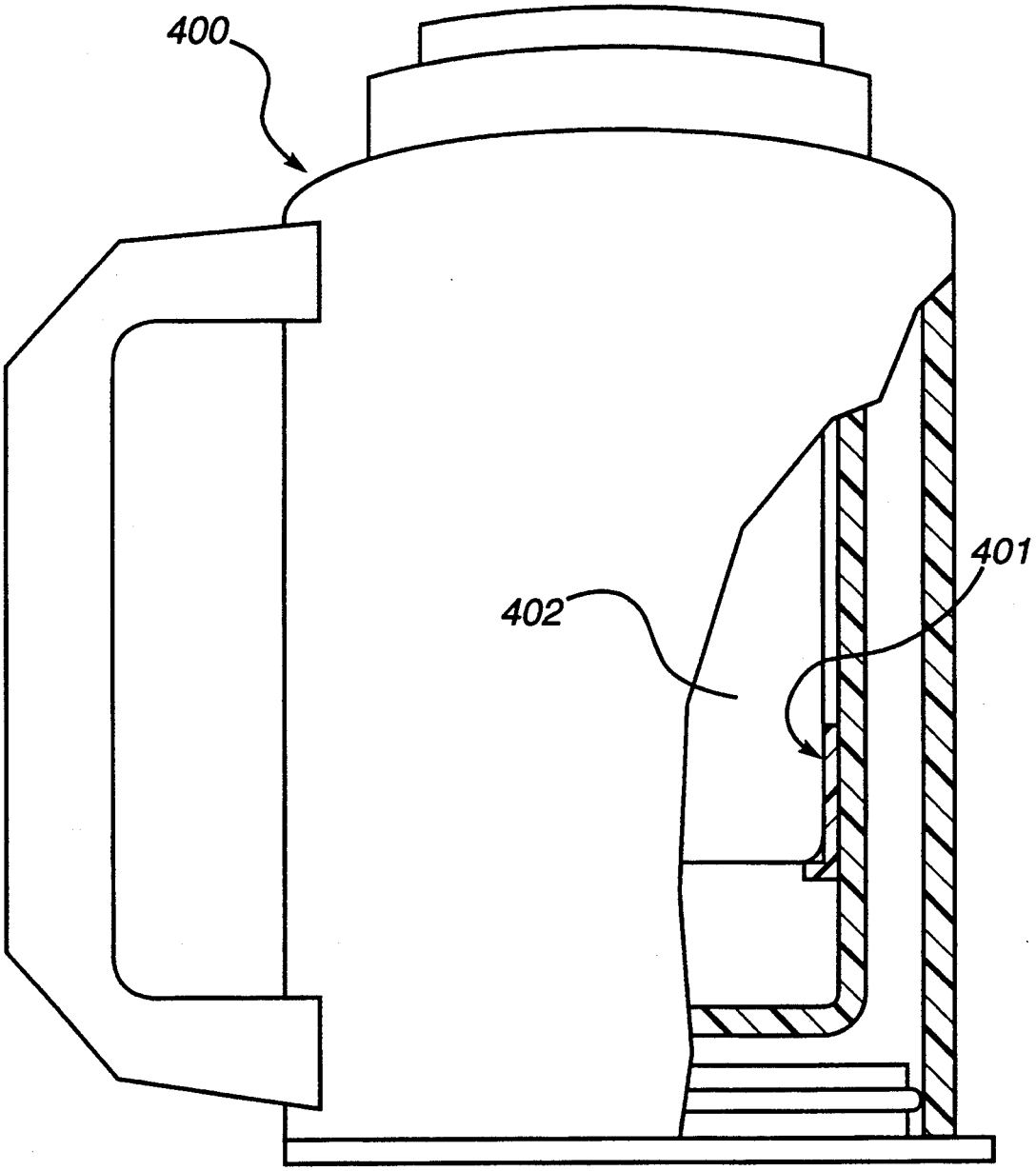
FIG. 9, is a front proportional view of an embodiment of the present invention in partial cross section showing an L-shaped can abutment means.

In FIG. 9, a further preferred embodiment of a mug 400 is illustrated. In this embodiment, can abutment means 401 is preferably L-shaped to provide support for both the side and bottom of can 402. Thus, lateral motion of can 402 is prevented.

Figure 10A:
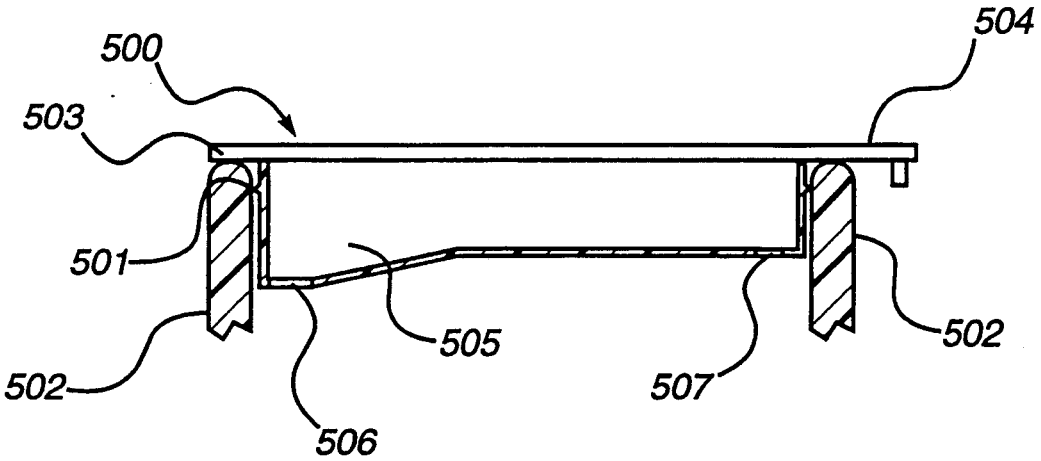
FIG. 10A is a side view of an embodiment of a lid.
Figure 10B:
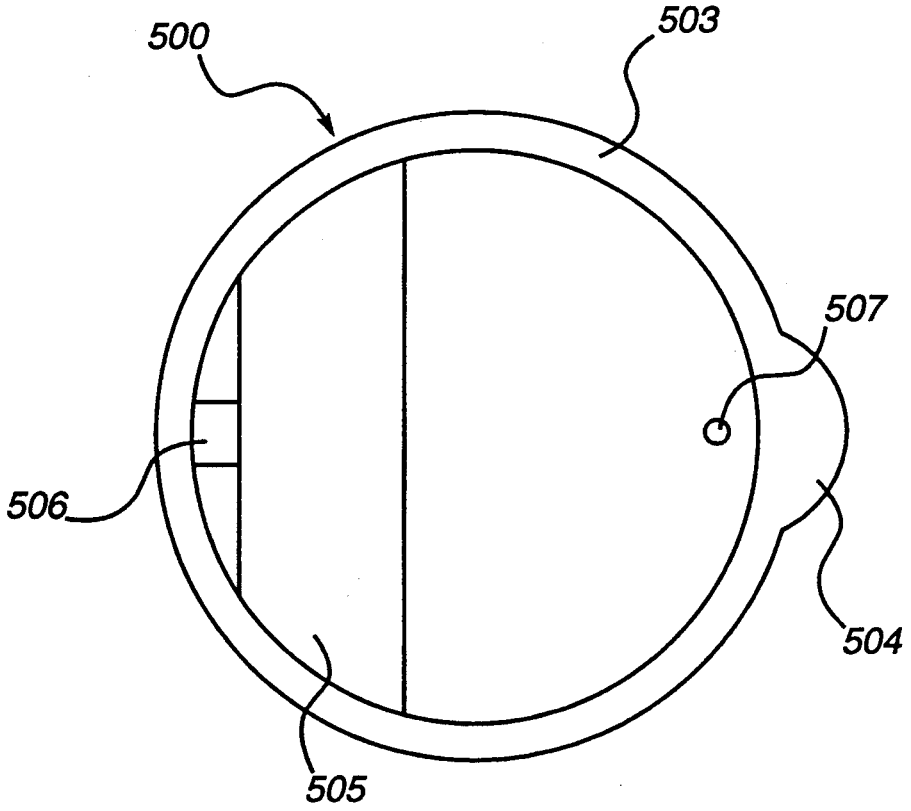
FIG. 10B is a top view of an embodiment of a lid.

In another preferred embodiment, a mug as described herein preferably includes a lid 500 as shown in FIGS. 10A and 10B. Lid 500 prevents spillage while traveling. As shown in FIG. 10A, lid 500 preferably includes an abutment means 501 for abutting an upper rim 502 of a mug (shown in partial cross-section in FIG. 10A). Rim abutment means 501 ensures a substantially leak-proof seal with rim 502.

Lid 500 also preferably includes a top portion 503 which rests upon rim 502 when lid 500 is set in place. Lid 500 also preferably includes a means 504 for facilitating removal of lid 500. In the embodiment shown in FIGS. 10A and 10B, removal means 504 comprises a tab extending beyond rim 502.

Lid 500 also preferably includes a depressed portion 505. At the bottom of depressed portion 505 and near the edge of lid 500, a first opening 506 is positioned for allowing a beverage to flow during drinking. Preferably, lid 500 also includes a second opening 507 to allow proper flow from first opening 506.

Figure 11A:
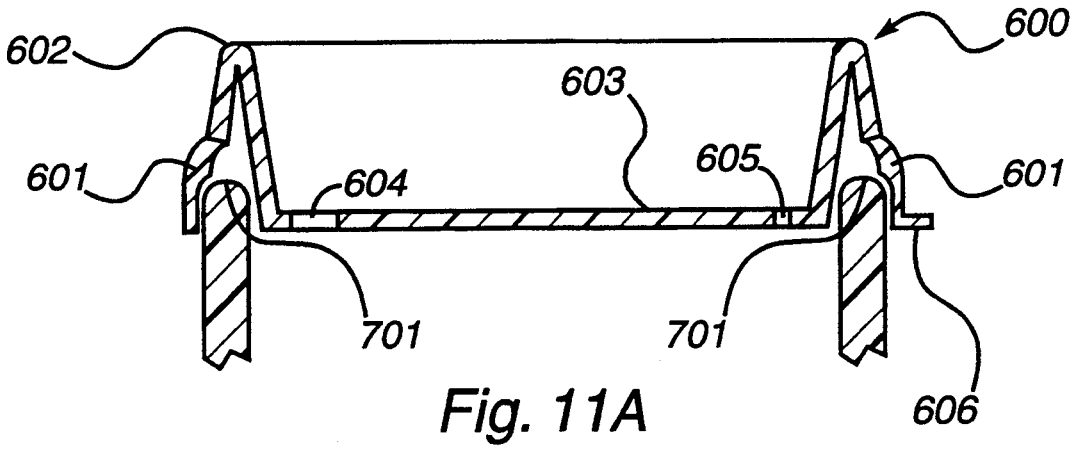
FIG. 11A is a side view of an embodiment of a lid.
Figure 11B:
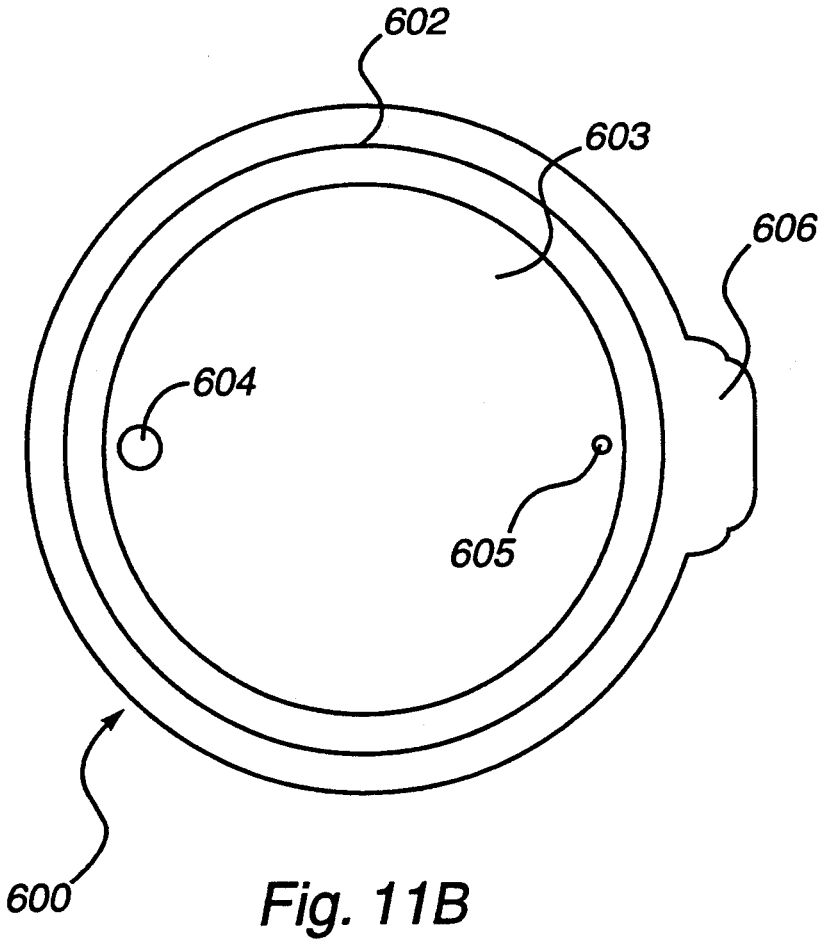
FIG. 11B is a top view of an embodiment of a lid.

Another embodiment of a lid for use in the present invention is shown in FIGS. 11A and 11B. Lid 600 includes an outer lip 601 which attaches to an upper rim 701 of a mug. Preferably lid 600 is made of a resilient material and attaches firmly to upper rim 701 to ensure a substantially leak-proof seal.

Lid 600 includes an upper rim 602 extending above upper rim 701 of the mug. Lid 600 also preferably includes a depressed portion 603. At the bottom of depressed portion 603. Near an edge of depressed portion 603, a first opening 604 is positioned for fluid flow. A second opening 605 is also positioned in depressed portion 603 to facilitate flow. Unlike lid 500 shown in FIGS. 10A and 10B, depressed portion 603 of lid 600 does not extend into the mug (i.e., below upper rim 701), thereby allowing a greater volume of fluid within the mug. Lid 600 also preferably includes tab 605 to facilitate removal.

Although the invention has been described in detail for the purposes of illustration, it is to be understood that such detail is solely for that purpose and that variations can be made therein by those skilled in the art without departing from the scope of the invention except as it may be limited by the claims.

What is claimed is:

1. A drinking container comprising an outer enclosing portion and an inner cup portion, said inner cup portion and said outer enclosing portion coming together near an upper rim of said container to form an annular space therebetween, said container further comprising a removable base element which abuts an inner wall of said outer enclosing portion at an outermost bottom circumference of said annular space when said removable base element is in place to enclose said annular space, and upon removal of said removable base element allowing unobstructed access to said annular space, said removable base element further comprising a means for releasing pressure from said annular space.

2. The container of claim 1 wherein said means for releasing pressure comprises a channel to provide communicative connection between the annular space and ambient air.

3. The container of claim 1 wherein said base element includes an annular abutment means and a support element.

4. The container of claim 1 wherein said annular space is of sufficient width to enclose articles when said base element is put in place.

5. The container of claim 1 further comprising an insulating sleeve disposed within said annular space.

6. The container of claim 3 wherein said base element further comprises a means for grasping said to facilitate removal thereof.

7. The container of claim 6 wherein said means from grasping is a tab extending outwardly from said support element.

8. The container of claim 1 further comprising at lease one abutment means for contacting a beverage can placed within the inner cup of said container.

9. The container of claim 8 wherein said at least one can abutment means is positioned so that an upper rim of the beverage can extends above an upper rim of said container.

10. The container of claim 8 wherein the inner cup is slightly wider than the diameter of the beverage can.

11. The container of claim 8 wherein said can abutment means provides both lateral and vertical support for the beverage can.

12. The container of claim 1 wherein said container is formed of an integral piece of material.

* * * * *